United States Patent [19]

Gunnergaard

[11] 3,965,961

[45] June 29, 1976

[54] METHOD OF OPERATING AUTOMATIC MOLD PART PRODUCING APPARATUS

[75] Inventor: Marius Gunnergaard, Lyngby, Denmark

[73] Assignee: Dansk Industri Syndikat A/S, Herlev, Denmark

[22] Filed: Dec. 6, 1974

[21] Appl. No.: 530,428

Related U.S. Application Data

[62] Division of Ser. No. 290,369, Sept. 19, 1972, Pat. No. 3,880,223.

[30] Foreign Application Priority Data

Sept. 23, 1971 Denmark ..... 4651/71

[52] U.S. Cl. ..... 164/40; 164/37; 164/200; 141/67

[51] Int. Cl.[2] ..... B22C 15/28

[58] Field of Search ..... 164/19, 20, 21, 22, 164/37, 40, 155, 200, 201, 202; 141/67, 68

[56] References Cited

UNITED STATES PATENTS 3,274,651 9/1966 Oliveira ..... 164/22 X 3,556,196 1/1971 Buhler ..... 164/40 X

FOREIGN PATENTS OR APPLICATIONS 603,754 8/1960 Canada ..... 164/40

*Primary Examiner*—Francis S. Husar
*Assistant Examiner*—Carl Rowold
*Attorney, Agent, or Firm*—Imirie, Smiley & Linn

[57] ABSTRACT

In an automatic mold part producing apparatus having a mold chamber which is filled with mold forming material that subsequently is compressed between a pair of opposite end walls, the mold forming material is forced into said mold chamber by means of pressurized air, the pressure of which is gradually or stepwise increased during the chamber filling operation, for the purpose of achieving uniform compactness or density of the mold forming material throughout the height of the mold chamber.

1 Claim, 4 Drawing Figures

METHOD OF OPERATING AUTOMATIC MOLD PART PRODUCING APPARATUS

This is a division of application Ser. No. 290,369, filed Sept. 19, 1972, now U.S. Pat. No. 3,880,223.

BACKGROUND OF THE INVENTION

This invention relates to a method of operating automatic mold part producing apparatus for continuous casting apparatus comprising a mold chamber which, on one side, is closed by a pressure plate or pattern board that reciprocally is displaceable in the axial direction and, on the other side, by a counterpressure plate or pattern board which, for preference, remains stationary during the pressing operation. Through one or more passage apertures the chamber communicates with a supply bin for sand or similar mold forming material which is forced into and fills the mold chamber and subsequently is compressed by the movement of the pressure plate towards the counterpressure plate.

A machine of this type for automatically producing mold parts is disclosed by Jeppesen U.S. Pat. No. 3,008,199. In practice, the mold chamber of this machine is, in its top and/or side walls, provided with one or more slots through which the sand from the supply bin is forced into the mold chamber, for instance, by means of centrifugal impellers or by the use of pressurized air.

When pressurized air is used for this purpose, the supply bin, after having received the requisite quantity of sand, is hermetically sealed off from the surroundings. Following this, the upper part of the supply bin is connected to a pressurized air tank so that the air pressure will force the sand into the mold chamber until it is filled.

When using the prior art apparatus it has been found that the compactness or density of the sand in the filled mold chamber decreases in the vertical direction and that this variation of the compactness changes only negligibly in the course of the subsequent pressing operation. This is connected with the circumstance that the sand possesses a very low degree of flow. The varying compactness of the sand has the effect that the pressure plate which, normally, rests on the bottom of the chamber, tends to rise slightly therefrom during the compressing movement whereby the precision of the mold parts produced is adversely affected. Moreover, by the termination of the compressing movement, portions or fractions of the mold part formed may be torn off as the pressing plate, during this phase, will again sink down into abutment against the bottom of the mold chamber.

In addition, the varying compactness of the sand results in a varying resilience in the mold part when relieved from pressure by the backward motion of the pressure plate. As a consequence thereof, the pressure-relieved mold part will have a slightly greater thickness at the bottom than at the top and, when assembling a series of such mold parts so as to form a coherent string of molds, it will not in all circumstances be possible to ensure the desired tightness at the contact faces between the individual mold parts.

SUMMARY OF THE INVENTION

The disadvantages enumerated above can be remedied by the method according to the invention the concept of which resides in increasing the speed at which the material particles are forced into the mold chamber during the chamber filling operation.

The increase of the particle velocity during the filling operation, in correlation with the very low degree of flow of the mold part material, results in a practically uniform material compactness in the vertical direction of the mold chamber, which is due to the circumstance that, during the filling of the chamber, the adverse effect of the gravitational force on the compactness of the material is compensated by the increase of particle velocity.

When, in a known manner, pressurized air is utilized to force the mold part material into the mold chamber, the air pressure above the volume of material present in the supply bin may be increased while the mold chamber is being filled. In this way it becomes possible, while using relatively simple means, to achieve the desired variation in the particle velocity during the filling of the chamber.

The invention also relates to an apparatus intended for carrying out the new method explained above. This apparatus comprises a supply bin which is connected with either at least one pressurized air tank via at least two valves that can be successively opened, or with at least two separate pressurized air tanks via individual valves that can be successively opened, or with at least one pressurized air tank via an adjustable valve which is controlled in such a way that its flow area increases while the mold chamber is being filled.

Each of the alternative embodiments is easy to realize in practice and each renders the desired increase in the air pressure possible during the filling of the mold chamber, if so required, in an automatic or semi-automatic manner.

DETAILED DESCRIPTION OF THE INVENTION

Figure 1:
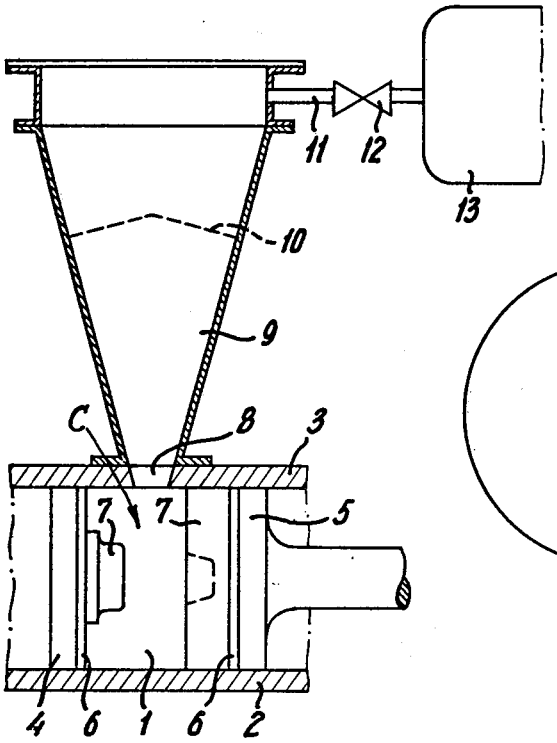
FIG. 1 is a longitudinal sectional view through the relevant components of an embodiment of the apparatus.

In FIG. 1, a mold chamber C having side walls I, a bottom 2 and a top wall 3, as well as two end walls that are constituted by a counterpressure plate 4 and a pressing plate or ram 5, respectively. These two end walls 4 and 5 each carry a pattern plate 6 and a model part 7.

Through a slot 8 in the top wall 3, the mold chamber C can receive sand or similar mould part material from a hopper-like supply bin 9 that is assumed to be filled with sand up to the level 10 shown in broken lines.

In the situation shown, bin 9 is sealed off from the surroundings but, via one or more ducts 11 with a valve 12, it communicates with one or more pressurized air tanks 13.

Figure 2:
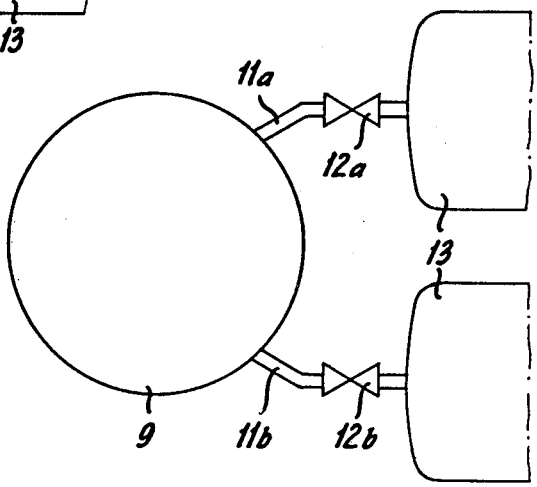
FIGS. 2, 3 and 4 are diagrammatic plan views of the apparatus in three different embodiments.

According to FIG. 2, the apparatus is provided with two pressurized air tanks 13 which through individual ducts 11a and 11b with associated valves **12*a* and 12*b* are connected to supply bin 9. At the start of the filling operation, only valve 12*a* is assumed to be open and, furthermore, the two pressurized air tanks 13 are assumed to have a uniform starting pressure. When the mold chamber C has been partially filled, valve 12*b* is also opened, whereby it is possible to achieve a pressure increase above the sand in supply bin 9**, such pressure increase requiring an increasing supply of air per unit of time inasmuch as the volume above the sand increases gradually as mold chamber C is being filled.

Other possibilities for operating the apparatus illustrated in FIG. 2 consist in allowing the two pressurized air tanks 13 to have different starting pressure and, possibly, different capacities, and the valves 12*a* and 12*b* may then be operative alternatively so that only one of these valves is open at a time. The flow capacity of the valves can be adjusted at will.

Figure 3:
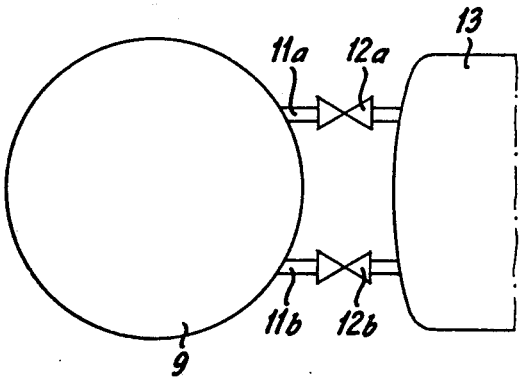

Also according to FIG. 3 the supply bin 9 is connected with two ducts 11*a* and 11*b* with valves 12*a* and 12*b*, but these ducts communicate with a common pressurized air tank 13. The operation can proceed as explained in connection with FIG. 2.

Figure 4:
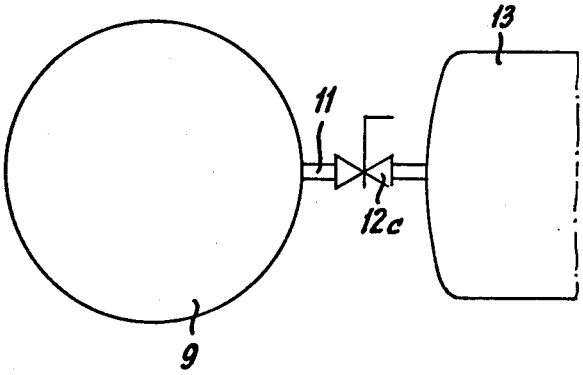

According to FIG. 4 the supply bin 9 communicates with a single pressurized air tank 13 via a single duct 11 fitted with an adjustable valve 12*c*. It is possible for this valve to be controlled according to a predetermined program with a view to changing the flow area, or else it may be controlled dependently upon the pressure actually prevailing inside supply bin 9 and pressurized air tank 13 in a way so as to achieve the desired filling process of mold chamber C.

I claim:

1. A method of operating mold part producing apparatus including a horizontally disposed mold chamber having a pair of opposite end walls constituted by an axially reciprocal pressure plate and a counter pressure plate, and a mold part form supply bin disposed above said chamber and having communication therewith through an opening in the top of said chamber, said method comprising the steps of supplying material from said bin to said chamber, supplying air under pressure into said bin above said material to apply a vertical force to said material, and increasing the air pressure on said material in said bin toward the latter part of the filling operation to uniformly compact the material the full height of said chamber before compression thereof in the chamber by the pressure plate.

* * * * *